United States Patent [19]

Fuller

[11] Patent Number: 5,003,142

[45] Date of Patent: Mar. 26, 1991

[54] EASY OPENING MICROWAVE POUCH

[75] Inventor: Robert E. Fuller, Wilmington, Del.

[73] Assignee: E. I. du Pont de Nemours and Company, Wilmington, Del.

[21] Appl. No.: 337,159

[22] Filed: Apr. 12, 1989

Related U.S. Application Data

[63] Continuation-in-part of Ser. No. 202,032, Jun. 3, 1988, abandoned.

[51] Int. Cl.[5] ..... H05B 6/64

[52] U.S. Cl. ..... 219/10.55 E; 426/107; 426/113; 426/241

[58] Field of Search ..... 219/10.55 E, 10.55 F; 426/107, 113, 114, 234, 241, 243; 99/451, DIG. 14; 383/68, 69

[56] References Cited

U.S. PATENT DOCUMENTS

| | | | |
|---|---|---|---|
| 4,122,324 | 10/1978 | Falk | 219/10.55 E |
| 4,267,420 | 5/1981 | Brastad | 219/10.55 E |
| 4,425,263 | 1/1984 | Nazarenko | 252/51 |
| 4,434,197 | 2/1984 | Petriello et al. | 427/407.1 |
| 4,780,587 | 10/1988 | Brown | 219/10.55 E |
| 4,789,748 | 12/1988 | Jen et al. | 549/58 |
| 4,851,632 | 7/1989 | Kaliski | 219/10.55 E |

FOREIGN PATENT DOCUMENTS

WO8803352 5/1988 PCT Int'l Appl. .

*Primary Examiner*—A. D. Pellinen
*Assistant Examiner*—David Osborn

[57] ABSTRACT

A film package is provided for containing, heating, and browning or crispening a food item, which incorporates shields covering seal areas and other areas of the package where two or more layers of susceptor-laden film are in contact in the absence of food as a heat sink. The shields prevent the protected areas from overheating.

27 Claims, 5 Drawing Sheets

EASY OPENING MICROWAVE POUCH

This application is a continuation-in-part of U.S. application 202,032, filed June 3, 1988.

BACKGROUND OF THE INVENTION

This invention relates to packaging materials useful for microwave cooking applications, and particularly to packaging materials which will brown and crispen food items without overheating and degradation of the seams of such packages.

There has been much interest recently in packaging materials which aid in browning and crispening of food items in a microwave oven. U.S. Pat. No. 4,267,420, to Brastad, discloses a food item wrapped with plastic film having a very thin coating thereon. The film conforms to a substantial portion of the food item. The coating converts some of the microwave energy into heat which is transmitted directly to the surface portion of the food so that a browning and/or crispening is achieved.

U.S. Pat. No. 4,641,005, Seiferth, discloses a disposable food receptacle for use in microwave cooking, which includes a provision to brown the exterior of the food in the receptacle. A thin layer of an electrically conductive material is incorporated into the receptacle on the food contacting surfaces thereof, so that the conductive layer will become heated by the microwave radiation and will, in turn, brown the exterior of the food in the receptacle. The receptacle includes a smooth surfaced plastic film, as a protective layer, and a support means formed of paper stock material.

U.S. Pat. No. 4,713,510, Quick et al., discloses a microwave ovenable package including a layer of material that will convert a portion of the microwave energy to heat and a layer of paperboard interposed between the energy-converting layer and the food. The energy-converting layer may be carried on a plastic film, and an additional layer of paperboard may be used to sandwich the energy-converting layer and the plastic film between layers of paperboard. For the purpose of providing a more intense heating effect, two energy-converting layers, each on a dielectric substrate, sandwiched together between layers of paperboard, are disclosed.

U.S Pat. No. 4,735,513, Watkins et al., discloses a flexible sheet structure comprising a base sheet having a microwave coupling layer which may be in the form of an island covering a selected area of the sheet. The sheet may be laminated to a backing sheet of dimensionally stable flexible material transparent to microwaves; backing sheets can be applied to both sides of the base sheet. The structure may have unheated portions which are adapted to be folded, tucked, and wrapped around a product to be heated.

Copending U.S. Pat. Application No. 188,556 discloses a conformable laminated wrap for packaging articles of food requiring browning and crispening and a degree of shielding during microwave cooking. The laminated wrap has at least two layers of heat resistant microwave transparent plastic film, and at least one substantially continuous layer of microwave susceptive material, which is coated on at least one of the interior surfaces or interfaces formed between the plastic films of the laminate.

The use of shields to reduce the amount of microwave radiation reaching food items is also known in the art. For example, U.S. Pat. No. 4,190,757, Turpin et al., discloses the use of metal foil to totally shield food from microwave energy except that which enters through an opening in the shield. The foil may be bonded to a layer of microwave lossy absorptive heating composition, as seen e.g. in FIG. 7 of that patent.

In packages suitable for browning or crispening food in a microwave oven, seals or seams may be present and microwave susceptive heating materials may be present near or as a part of the seal. Alternatively, areas of a microwave package coated with a microwave susceptor may be located in contact with each other, yet not in close contact with food. A problem is often encountered with overheating and in severe cases even melting of the film in such areas where there is no close contact with food to act as a heat sink. Melting of the polymer can cause the package to deform and the layers of film to adhere together, and in severe cases may even cause contamination of the food with molten polymer. The present invention avoids these problems by selectively providing shielding for such areas, thereby providing a package in which the film remains unmelted and the package remains easy to open.

SUMMARY OF THE INVENTION

The present invention provides a microwave cooking package suitable for cooking a food item which requires surface browning or crispening, comprising a front leaf and a back leaf formed from at least one heat resistant film, said film having a microwave susceptor material extending over at least a portion of its surface area in an amount to generate sufficient heat under microwave cooking conditions to brown or crispen the surface of said food item placed adjacent thereto, said front and back leaves being maintained in contact with each other, face to face, in an area about the periphery of such front and back leaves so as to form a pouch of a size and shape suitable for containing said food item, wherein said susceptor material extends over at least a portion of the peripheral contacting area, and wherein said susceptor-laden portion of the peripheral contacting area is selectively provided with a shield to minimize exposure to microwave irradiation, whereby said susceptor-laden contacting area does not overheat during microwave cooking.

DETAILED DESCRIPTION OF THE INVENTION

Figure 1:
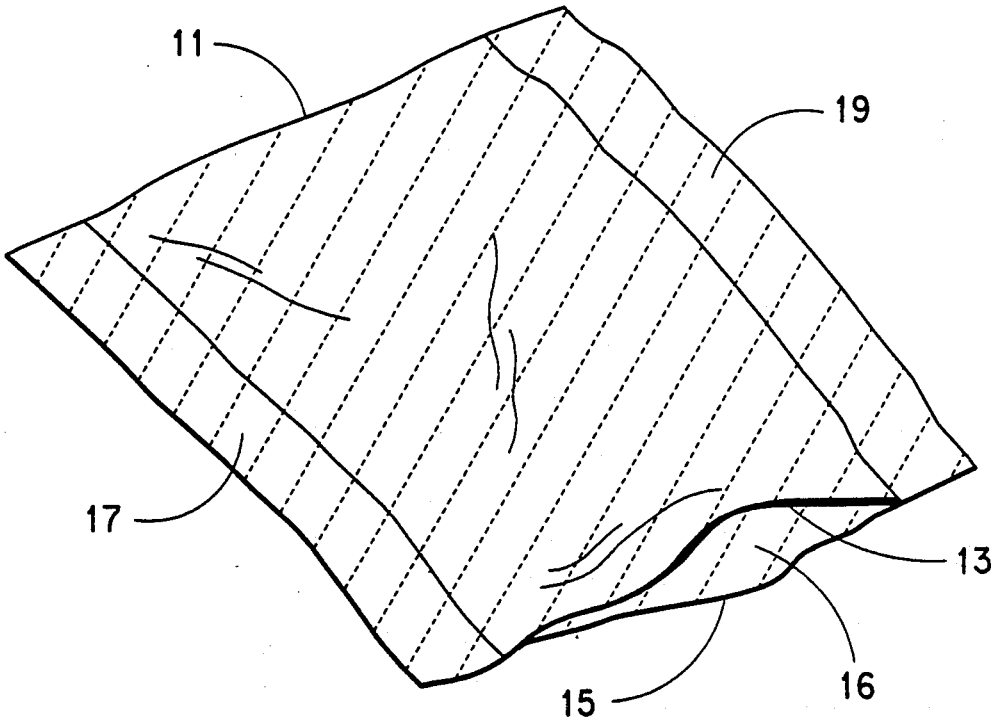
FIG. 1 (PRIOR ART)
FIG. 1 shows one form of a pouch suitable for preparing the package of the present invention.

The present invention comprises a heat resistant film structure which forms a package suitable for containing, browning, and crispening a food item in a microwave oven. The base film of the structure is a heat resistant, microwave transparent plastic film. This film may be made from any suitable plastic film which has the desired properties of heat resistance and microwave transparency. The term "heat resistant" refers to the ability of the film to withstand the temperatures generated in a 700 watt microwave oven during cooking without melting or degrading when in contact with a food item. When the film is made into the package of the present invention, temperatures of up to about 220° C. or more may be encountered under microwave cooking conditions, so the film should maintain its integrity at such temperatures. Certain polyesters, such as polyethylene terephthalate (PET), having a melting point of about 260° C., are particularly suitable for this purpose. Other suitable materials may include certain types of polyesters, polyamides, cellophane, cellulose triacetate, ethylene chlorotrifluoroethylene copolymers, fluorinated polyethylene, polyimides, polysulfones, polyvinyl alcohol polymers, polyetheretherketones, polytetrafluoroethylene, and others.

The heat resistant base film is provided with a microwave susceptive material in the form of a coating or layer which extends over at least a portion of its surface area. The coating may be of any material suitable for conversion of at least a portion of incident microwave radiation to heat, preferably by interacting with at least the electric component of the microwave field. For example, the susceptive material can be in the form of a coating of (i) about 5 to 80% by weight of metal or metal alloy susceptor in flake form, embedded in (ii) about 95 to 20% by weight of a thermoplastic dielectric material. More preferably the relative amount of such susceptor will be about 25 to 80 % by weight, and most preferably about 30 to 60 % by weight. A coating thicknesses of about 0.01 mm to about 0.25 mm (about 0.4 to 10 mils) is suitable for many applications. The surface weight of such a susceptor coating on the substrate is from about 2.5 to 100 $g/m^2$, preferably about 10 to about 85 $g/m^2$.

Suitable thermoplastic dielectric materials in which the susceptor flake may be embedded include, but are not limited to, polyesters selected from the group consisting of copolymers of ethylene glycol, terephthalic acid, and azelaic acid; copolymers of ethylene glycol, terephthalic acid, and isophthalic acid; and mixtures of these copolymers.

Suitable susceptor flake materials for use in this embodiment of the invention include aluminum, nickel, antimony, copper, molybdenum, iron, chromium, tin, zinc, silver, gold, and various alloys of these metals. Preferably the susceptor flake material is aluminum. The flakes of the susceptor should have an aspect ratio of at least about 10, and will preferably have a diameter of about 1 to about 48 micrometers, and a thickness of about 0.1 to about 0.5 micrometers. In order to obtain uniformity in heating, it is preferred that the flakes be approximately circular, having an ellipticity in the range of about 1:1 to 2. Alternatively, the flakes, if not circular, can be applied to the film in two or more separate passes, which also provides an improvement in the degree of uniformity of heating. Films prepared from such material will typically have a surface resistance of at least $1 \times 10^6$ ohms per square, and are normally optically opaque. Such films are described in more detail in copending U.S. Application No. 002,980, filed Jan. 20, 1987, the disclosure of which is incorporated herein by reference.

Alternatively, the base film can be coated with a thin layer of susceptor material by vacuum deposition techniques. In this embodiment, the susceptor material can be a substantially continuous electrically conductive material which is present in sufficient thickness to cause the multilayer structure to heat under microwave cooking conditions to a temperature suitable for browning or crispening of food placed adjacent thereto, but not so thick as to completely prevent penetration of microwave energy to the interior of the food. A preferred susceptor material is vacuum metallized aluminum, which will preferably be present in sufficient amounts to impart an optical density of about 0.10 to about 0.35, preferably 0.16 to about 0.22, to the film. Other metals, of course, may be used, including gold, silver, mumetal, stainless steel, nickel, antimony, copper, molybdenum, bronze, iron, tin, and zinc. Methods other than vacuum deposition may also be used if they provide a substantially continuous layer of the desired thickness.

The amount of susceptor material applied to the film, whether metal flake, continuous metallized layer, or other material, may be varied within certain limits which will be apparent to one skilled in the art. The test to determine the correct amount of material is whether the coating will heat to the proper temperature and provide sufficient heat flux for browning or crispening of food items. The required temperature may depend on the particular food item used but for many applications is at least about 180° C.

It is preferred that the film of the present invention be a laminate comprising at least one layer of heat stable resin in addition to the layer of resin on which the susceptor materials is located. Such laminates are more fully described in copending U.S. Pat. Application No. 188,556, filed Apr. 29, 1988, the disclosure of which is incorporated herein by reference. The presence of such a heat stable resin layer in a laminated structure provides a limited, controlled amount of shrinkage to the film. Particularly preferred for this layer is heat stabilized polyethylene terephthalate. Heat stabilized PET is made from a regular grade of PET film by a stabilization process involving a series of heat treatment and relaxation steps, and is well known to those skilled in the art. A heat stabilization process for PET is more fully described in Bulletin E-50542, "Thermal Stabilization of Mylar ®," from E. I. Du Pont de Nemours and Company. Heat stable films, of course, may include films other than heat stabilized PET, including those listed above, provided such films have the desirable property of minimal shrinkage under microwave cooking conditions.

The film used for the present invention will preferably also include a layer of a relatively low melting thermoplastic material over at least a part of its surface, suitable for sealing the film together to form a package. Suitable materials include polyesters selected from the group consisting of copolymers of ethylene glycol, terephthalic acid, and azelaic acid; copolymers of ethylene glycol, terephthalic acid, and isophthalic acid; and mixtures of these copolymers.

The susceptor material may extend over the entire surface area of the film, or it may be limited to certain selected areas. For example, if the film is prepared as a roll of film, it is convenient to provide the susceptor material as a stripe of an appropriate width down the middle of the film.

Figure 2:
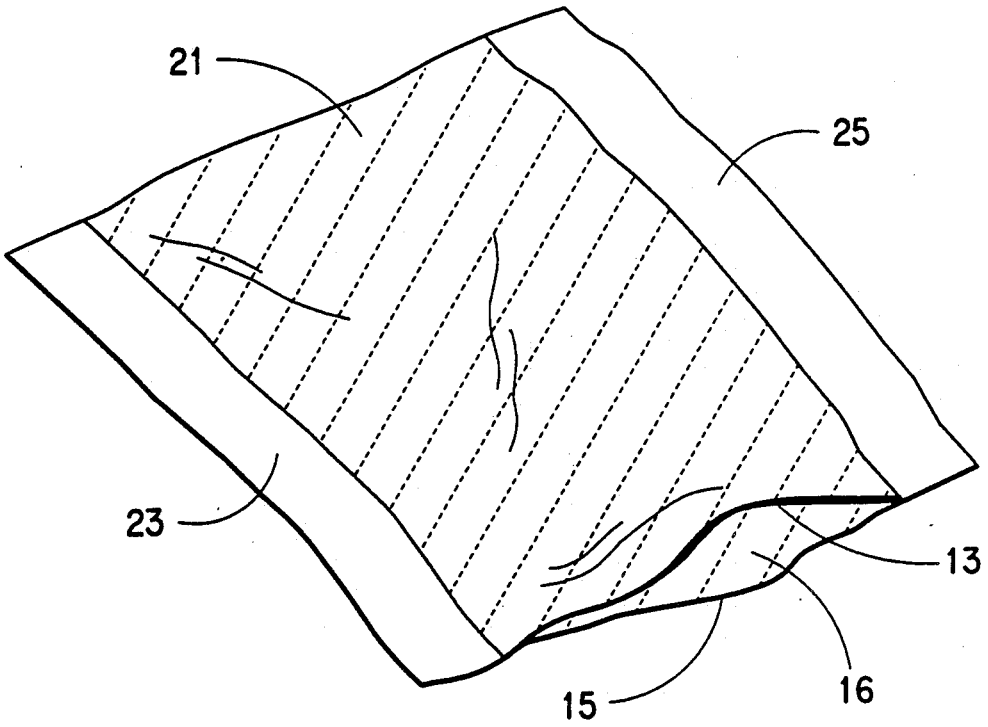
FIG. 2 (PRIOR ART)
FIG. 2 shows another form of a pouch suitable for preparing the package of the present invention.

The package of the present invention is prepared first by making an open pouch from a piece of the above described film of a suitable size for containing a food item to be heated. The pouch may be formed from one or more pieces of film, forming front and back leaves. The leaves are maintained in contact with each other so as to form an open pouch suitable for holding the food item. The leaves may be maintained in contact by any suitable means, including mechanical means such as stapling or sewing, but preferably are sealed together by use of an adhesive or a sealable thermoplastic resin, as discussed above. It is most preferred that the pouch be formed from a single piece of film, folded over on itself and sealed along the edges. Such open pouches are shown in FIGS. 1 and 2. FIG. 1 shows a pouch in which the entire surface area of the film is overlain with the susceptor material. This figure illustrates the crease, 11, whereby the sheet is folded to form the front and back leaves (13 and 15, respectively) of the pouch, and two areas, 17 and 19, forming a seal between the two leaves. The seal may be formed by heating the seal areas with a hot iron, or by other means. An opening, 16, is provided at one end for insertion of food items. FIG. 2 shows a similar pouch in which the susceptor-laden area is limited to a stripe, 21, down the center of the film. The seals at the edge of the pouch, 23 and 25, in this case are formed from susceptor-free material. Of course, the pouch can also be formed be wrapping the film around a food item which is already in place, and then sealing it.

Figure 3:
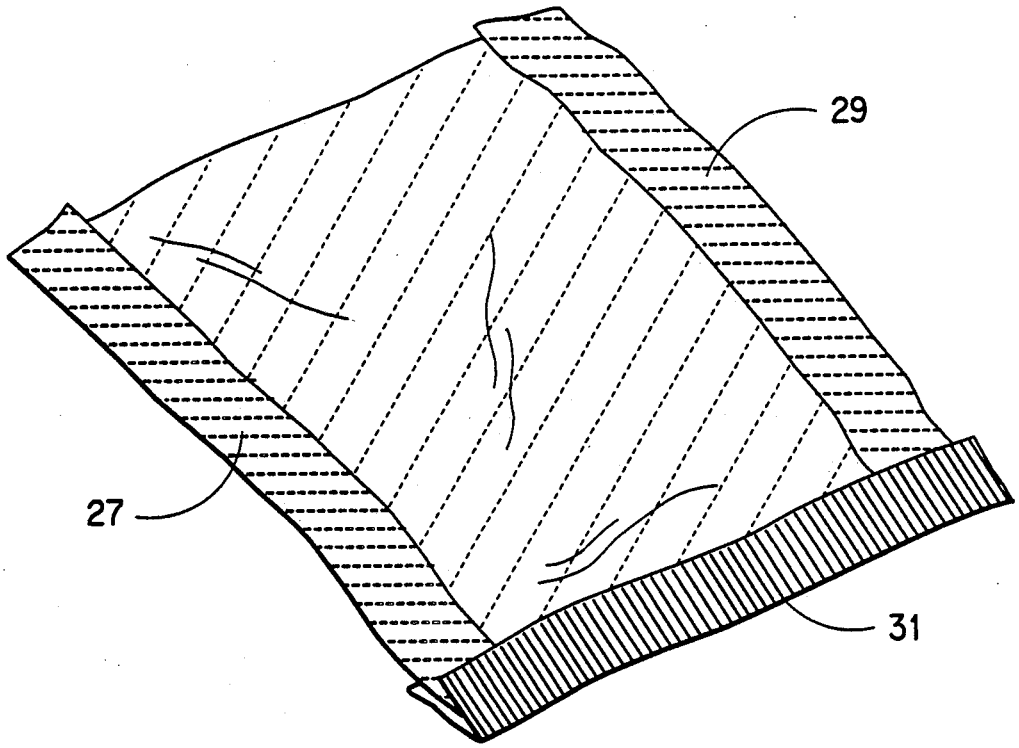
FIG. 3 a package of the present invention based on the pouch of FIG. 1.
Figure 4:
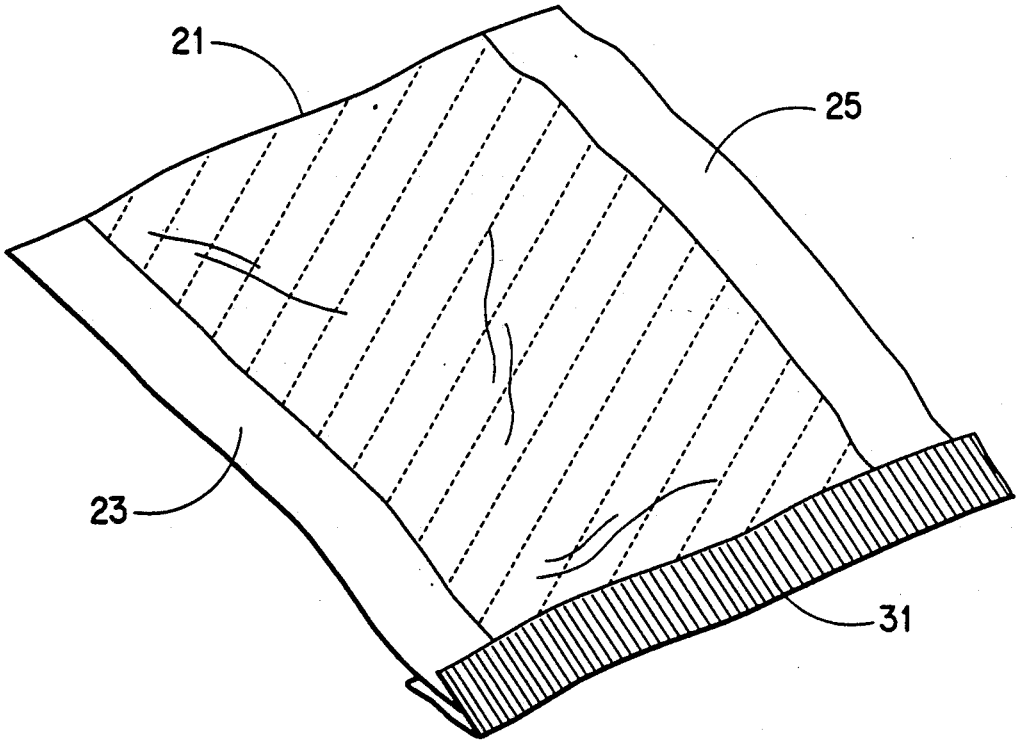
FIG. 4 shows a package of the present invention based on the pouch of FIG. 2.
Figure 7:
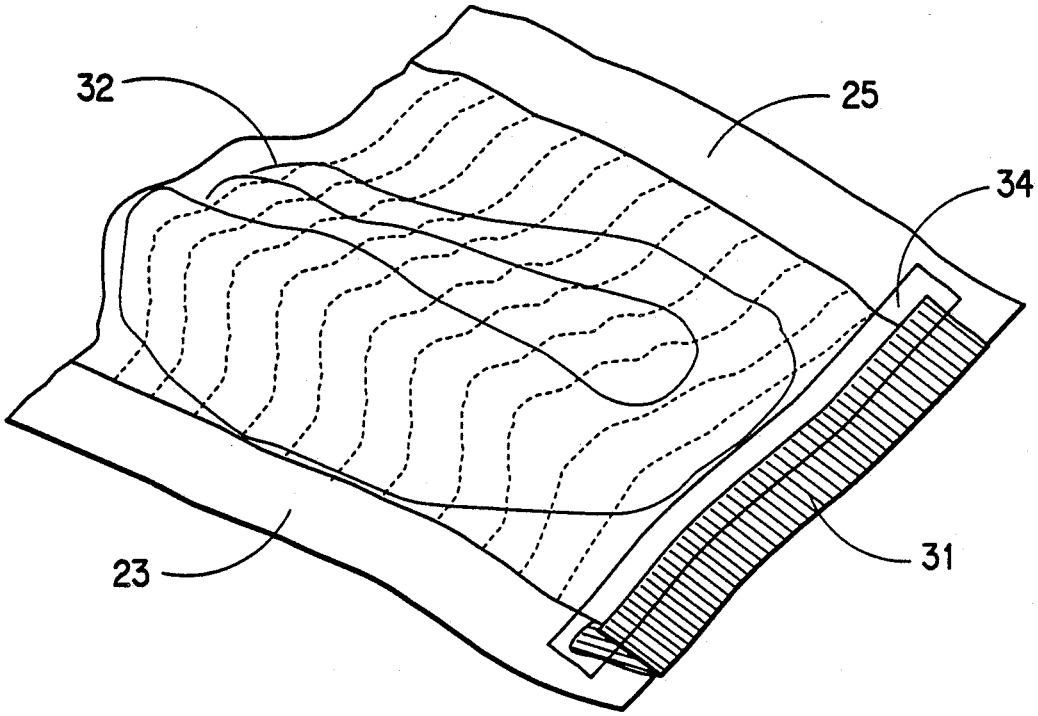
FIG. 7 shows an embodiment of the invention containing a food item.

An important feature of this invention is that the areas of the package in which two or more layers of susceptor material are in contact with each other, and in the absence of a heat sink such as a food item, should be protected from exposure to microwave irradiation. FIGS. 3 and 4 show one method in which this protection can be effected. In FIG. 3, which corresponds to FIG. 1, seal areas 17 and 19 (not visible) are covered with microwave reflective shields, 27 and 29, such as metal foil or metallized paper. The opening, 16, is closed (after insertion of food item), either mechanically or by sealing. The now-closed opening 16 (not visible) is covered by a similar microwave reflective shield, 31. FIG. 4 corresponds to FIG. 2. In this embodiment shields are not required over the clear side seals, 23 and 25, since no susceptor material is present. But shield 31 is present to cover the opening 16 (which may optionally be sealed). Such shields effectively prevent the regions of adjacent susceptor materials from overheating, distorting, and perhaps melting due to the intense heat generated in the microwave field in the absence of a heat sink. In actual use the package will contain a foodstuff, 32, such as shown in FIG. 7. The foodstuff both provides a heat sink for the heat generated by the susceptor materials adjacent thereto and also provides physical separation of layers of susceptor material. Thus the film adjacent to a foodstuff does not tend to overheat and does not need to be shielded. In FIG. 7 the reflective shield is shown affixed to the package by one (or more) piece of heat resistant tape, 34.

Figure 5:
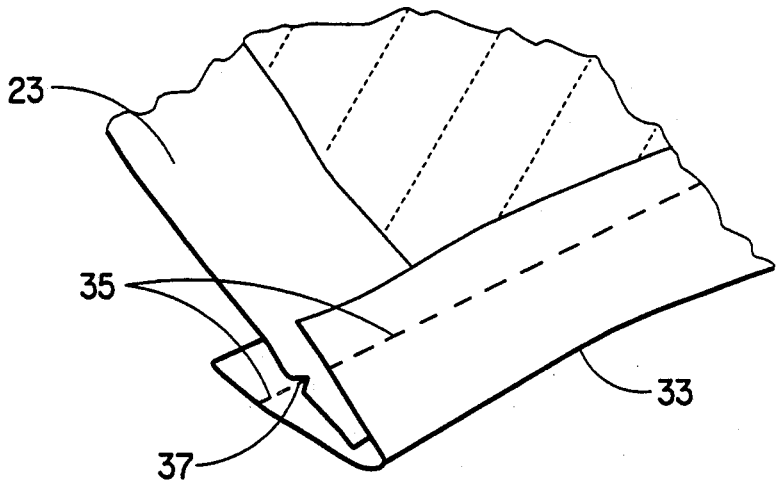
FIG. 5 provides a detailed view of one embodiment of a shield for the present invention, based on pouch of the FIG. 2.

There are of course many possible modifications in the type of shield that can be used. FIG. 5 shows in detail a portion of one such shield, 33, prepared from aluminum foil laminated to paper. This shield may be, if desired, sealed to the package. The foil-paper laminate contains a perforated line, 35, to permit it to be ripped. Beneath the shield, the film contains a notch, 37, at one or both edges, aligned with the perforation. Such a package can be readily opened by tearing along the perforation.

Figure 6:
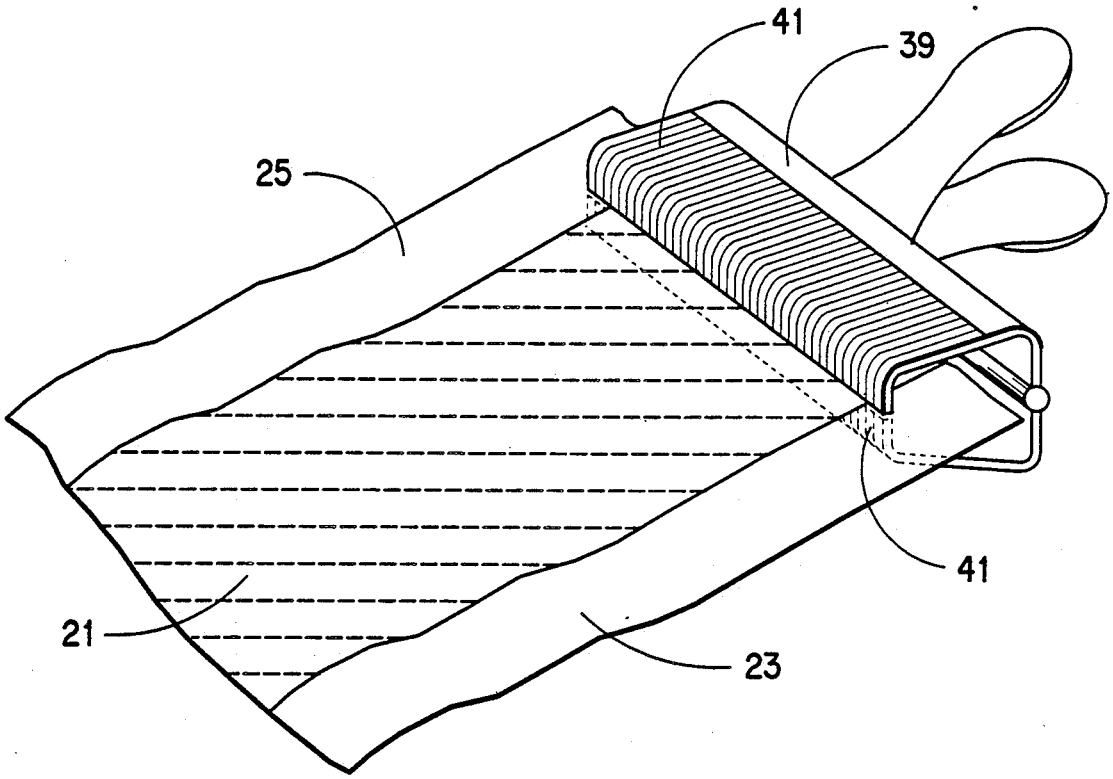
FIG. 6 shows another embodiment of the present invention.

Another readily opened package is shown in FIG. 6. The open end of this package is not sealed shut, but is mechanically held shut by means of a plastic clip, 39. The clip has at least one layer of a shielding material, 41, on both of the areas which overlie the susceptor-laden areas in contact with each other. The shielding material may be aluminum foil, taped, glued, or otherwise attached to the clamp, or the clamp itself may be in part or in whole made of metal, thereby providing shielding. (Fully metal clamps or other metal articles are sometimes undesirable for use in certain microwave ovens because of the possibility of arcing.)

Figure 9:
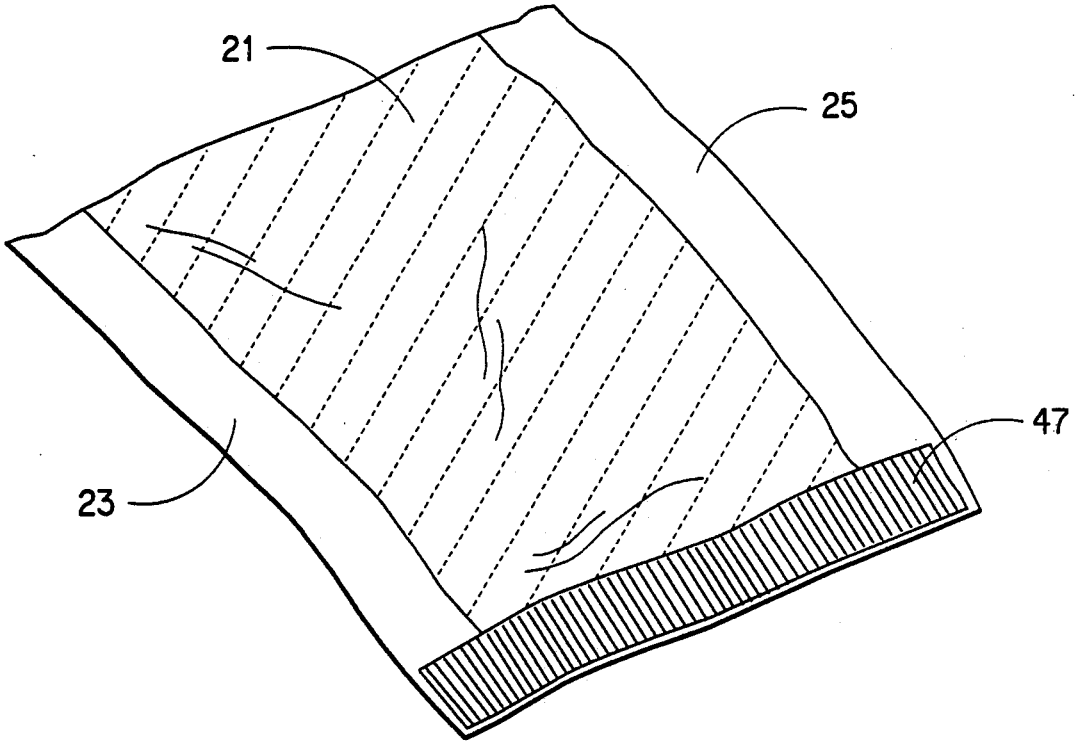
FIG. 9 shows an alternative embodiment of the present invention.

It has also been found that the shield need not be applied to both leaves of the area to be protected. FIG. 9 illustrates such a package, in which a single laminated shield is applied to one side only of a susceptor-laden contacting or sealed area (compare FIGS. 2 and 4). Application of a shield to only one side of the package is in many instances equally effective at preventing overheating or melting. Surprisingly this is true even when the package is oriented so that the shield is located below the area to be protected, i.e., away from the source of microwave energy.

Figure 10:
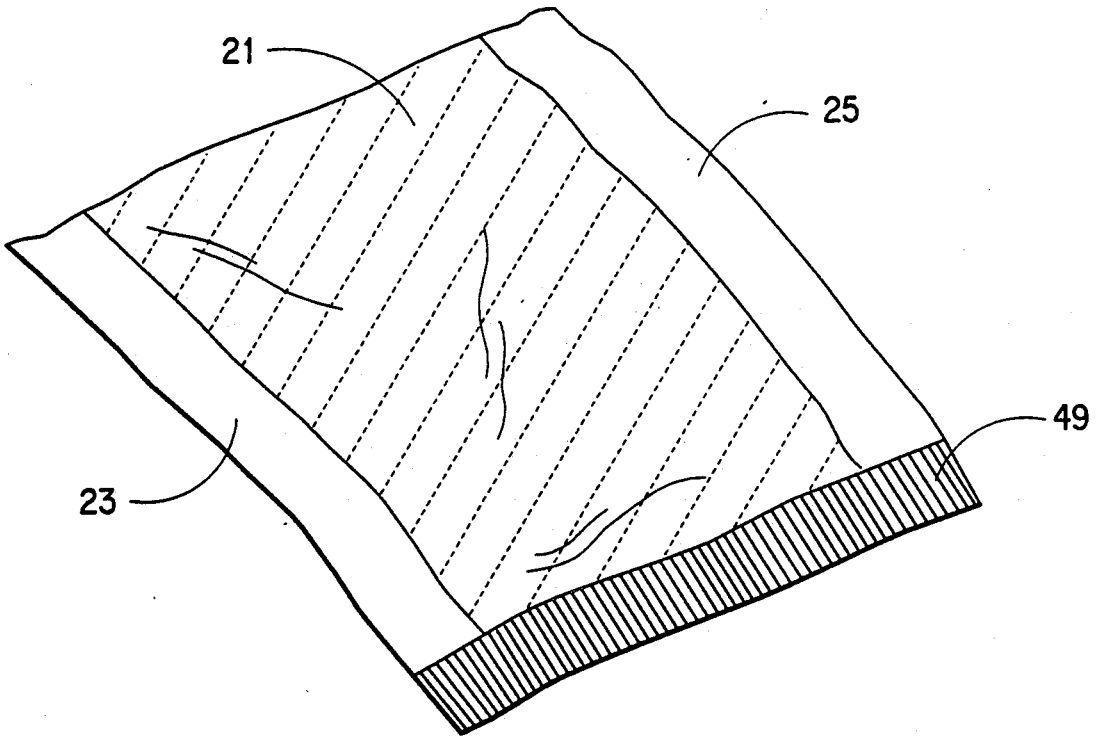
FIG. 10 shows another alternative embodiment of the present invention.

Yet another embodiment of the present invention is shown in FIG. 10. In this figure the shield 49 (which likewise may be applied to one or both leaves of film) is a layer of electrically conductive ink which is applied directly to the package, e.g., by printing. Such electrically conductive inks are described in detail in U.S. Pat. No. 4,425,263, the disclosure of which is incorporated herein by reference. Such an embodiment can represent a particularly economical means of providing shielding to selected areas of seals.

EXAMPLE 1

A pouch was formed from a piece of film about 25 cm wide and about 40 cm long, with a central stripe of susceptor material about 9 cm wide running the length of the piece. The film was a multiple layer structure, formed from a central layer, about 9 cm wide, of polyethylene terephthalate metallized with aluminum to an optical density of about 0.17–0.19. Onto both surfaces of this metallized film were laminated outer layers of heat stabilized PET film, about 25 cm wide and 0.012 mm thick (from Toyobo). This lamination was effected using a layer of adhesive, "Adcote" 506-40 (crosslinkable copolyester, from Morton Thiokol). (After lamination the laminate is stored, rolled on a paper oore for at least three days at room temperature in order to ensure complete curing of the adhesive.) The PET film was also coated with a layer of heat sealable polyester resin, located on one outer surface. This heat sealable layer was the condensation product of 1.0 mol ethylene glycol with 0.53 mol terephthalic acid and 0.47 mol azelaic acid, also containing small amounts of erucamide and magnesium silicate. The structure of the central portion of the film may thus be represented as H/P*/H+, where "H" is the heat stabilized PET film, "/" represents the adhesive, "P" is 0.012 mm PET film, the "*" indicates the location of the layer of aluminum metallization, and the "+" indicates the layer of heat sealable polyester resin.

The film so prepared was formed into a pouch as shown in FIG. 2 by folding the film, with the heat sealable polyester facing inward, and sealing the transparent edges with a hot iron. Into the pouch was inserted a frankfurter in a bun, and the remaining open end was manually pressed closed and covered with a shield prepared by laminating layers of 30#bleached Kraft paper, aluminum foil, and heat stabilized PET, folded, to form a package as shown in FIG. 7. (In this and succeeding examples, this laminated shield structure was generally secured to the package using heat resistant tape based on a polyimide film.) This package was placed in a 700 watt microwave oven, atop an inverted paperboard tray, and heated at full power for 1 minute. At the end of the cooking time the frankfurter was hot and the bun was hot and crispy on the outside. No overheating of the protected film was observed and the package was easy to open.

EXAMPLE 2

A pouch similar to that of Example 1 was prepared, except that the film used for the central susceptor region was PET metallized with aluminum to an optical density of about 0.13–0.15. The pouch was filled with commercial frozen french fries, and the end of the pouch was heat sealed. The sealed end was covered by a folded piece of the aluminum laminate, as in Example 1. The package was cooked in the same oven as in Example 1 at full power for 4 minutes and 20 seconds. Severe melting of the film was observed in all unprotected areas of the film, and the french fries were overcooked, but the area under the protective shield was free from signs of overheating.

EXAMPLE 3

Into a pouch prepared as in Example 1 was placed a dinner roll. The open end was held closed with a shielded clip, which was made using a commercially available plastic clip sold to reclose opened packages of e.g. potato chips (sold by HOAN products, Ltd, Mahwah, N.J.). The plastic clip was shielded by taping aluminum foil to the outer surfaces of the clip, as indicated in FIG. 6. The package containing the roll was cooked at full power for 30 seconds. After cooking, no apparent heating of the film under the shielded portion of the clip had occurred, and the package was easy to open.

EXAMPLE 4

Example 3 was repeated except that the open end was heat sealed, and the clip extended beyond the seal inward toward the roll. After heating in the microwave oven, a small notch was cut in the pouch extending inward for a short distance through the transparent side seal, parallel to the end seal, and within the area of the pouch which had been protected by the clip. Using this notch as a stress riser, the package was easily torn open.

EXAMPLE 5

Example 3 was repeated except that the open end of the pouch was manually closed and protected with aluminum coated paper. Only minor heating of the film area under the foil shield was observed.

EXAMPLE 6

Example 4 was repeated except that aluminum foil, rather than aluminum coated paper, was used as a shield. The shielded area was protected, although some minor overheating was observed.

EXAMPLE 7

Figure 8:
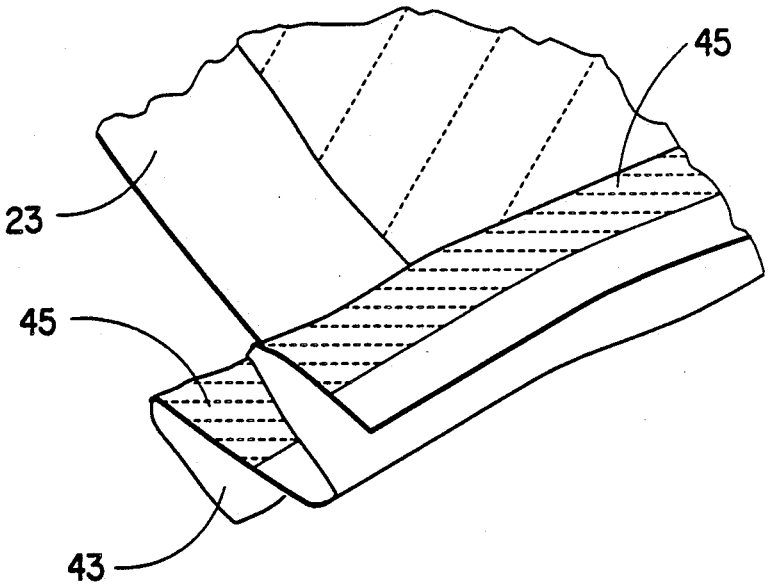
FIG. 8 shows a detailed view of another embodiment of a shield for the present invention.

Example 4 was repeated except that the shield was prepared from a double layer of aluminum foil taped to heavy paper, as shown in detail in FIG. 8. The heavy paper, 43, was folded into a "W" configuration. The aluminum foil, 45, was taped to the regions indicated in FIG. 8, on both legs of the "W", and the sealed portion of the package was inserted into the bottom of the "W" as shown in the FIG. The results were similar to those of Example 5.

COMPARATIVE EXAMPLE 1

Example 3 was repeated except that the open end of the pouch was closed by heat sealing, and the seal was not protected by either a clip or by foil. The sealed area containing the susceptor material was severely overheated, with melting and burn through, and the package was difficult to open.

COMPARATIVE EXAMPLE 2

Comparative Example 1 was repeated, except that the film was prepared from two 9 cm wide strips of PET, each coated using two passes with a layer of aluminum flakes embedded in a thermoplastic polymeric matrix of the condensation product of 1.0 mol ethylene glycol with 0.53 mol terephthalic acid and 0.47 mol azelaic acid. The aluminum flakes were from Reynolds Metals, and were about 0.1 micrometers thick and about 30–50 micrometers in diameter. Each strip of PET film was provided with a total coating of about 20 $g/m^2$, including about 9 $g/m^2$ of aluminum flake. The coated strips were laminated together, and the laminated strip so formed was further laminated between two 25 cm wide layers of heat stabilized PET, as used in Example 1. The adhesive used for these laminations was the same as that of Example 1. The final laminate was treated on one side with heat sealable polyester resin, as in Example 1. A dinner roll was placed into the pouch and the open end was sealed. After cooking the package in the microwave oven for 45 seconds, distortion and blowout of the end seal was observed.

EXAMPLE 8

Comparative Example 2 was repeated, except that the pouch was not sealed, but was rather closed with the shielded clip used in Example 3. The shielded area was thus protected from overheating, although some arcing was observed from the clip to the film.

EXAMPLE 9

Comparative Example 2 was repeated, except that the pouch was made with a film having susceptor material throughout its entire width. Thus the seals along the edges and the end of the package all contained susceptor material. The seals were protected on all three sealed edges by the aluminum-paper laminate described above, folded over the seals and taped to the closed pouch. After cooking there was almost no distortion or overheating of the package or sealed areas.

COMPARATIVE EXAMPLE 3

Example 9 was repeated without the shielding. After cooking, severe distortion and overheating of the package was observed.

EXAMPLE 10

Example 5 was repeated except that an aluminum-paperboard-PET shield was prepared which included an additional layer of PET coated with the heat sealable polyester resin described in Example 1. The shield was folded over the unsealed end of the pouch, the heat sealable resin coating facing inward towards the pouch, and sealed to the pouch by using a hot iron. No additional tape was used. After cooking, the shielded area showed no signs of overheating.

EXAMPLE 11

A dinner roll was sealed in a pouch formed as in Example 1. The entire package was sealed closed, including the area having susceptor-to-susceptor contact. A shield of Kraft paper, aluminum foil, and heat stabilized PET, as described in Example 1, was sealed using a polyester adhesive to one face only of the susceptor laden seal, as shown in FIG. 9. Upon heating the package in a microwave oven for 30 seconds, the area protected by the shield exhibited no melting. The same result was observed regardless of the package orientation. That is, no melting was observed if the shield was overlying the susceptor-laden seal area. Likewise no melting was observed when a second identical package was heated inverted, with the shield underlying the seal area.

EXAMPLE 12

A frozen bagel was sealed in a package prepared from a film laminate identical to that of Example 1 except that the Adcote adhesive was replaced by additional layers of the heat sealable polyester resin. The front and back leaves were sealed together face-to-face with a hot iron on all four sides around the bagel. The susceptor extended to the edge of both front and back leaves, so that the susceptor-laden seal surrounded the bagel. The seal along one edge of the package was thickly coated (on both front and back leaves) with a conductive ink composition of about 62.5% silver powder in a medium of diethylene glycol monoethyl ether acetate and polyester resin. The seals along the remaining edges were not coated. The coating was cured by heating the package in a convection oven for 20 minutes at about 150° C.

After curing, the package was heated in a microwave oven for 30 seconds. All three uncoated seal areas exhibited melting. The seal area which was coated with the conductive ink did not melt.

EXAMPLE 13

Example 12 was repeated except only one face of the seal was coated with the conductive ink. No melting of the coated area occurred.

I claim:

1. A package suitable for cooking a food item with a microwave field having electric and magnetic components, which food item requires surface browning or crispening, said package comprising a front leaf and a back leaf formed from at least one heat resistant film, said film having a microwave susceptor material extending over at least a portion of its surface area in an amount to generate sufficient heat under microwave cooking conditions to brown or crispen the surface of said food item placed adjacent thereto, said front and back leaves being maintained in contact with each other, face to face, in an area about the periphery of such front and back leaves so as to form a pouch of a size and shape suitable for containing aid food item, wherein said susceptor material extends over at least a portion of the peripheral contacting area, and wherein said susceptor-laden portion of the peripheral contacting area is selectively provided with a microwave reflective shield to minimize exposure to microwave irradiation, whereby said susceptor-laden contacting area does not overheat during microwave cooking.

2. The package of claim 1 wherein the microwave susceptor material interacts with at least the electric component of the microwave field.

3. The package of claim 1 wherein the front and back leaves are formed from a single sheet of film, folded over on itself.

4. The package of claim 3 wherein the microwave susceptor material is in a centrally located stripe extending the length of said single sheet of film, perpendicular to the direction of the fold, and the contacting portions of the front and back leaves comprise the areas on either side of the centrally located stripe and an area at either end of said stripe, wherein the susceptor-laden contacting areas at either end of said stripe are shielded from exposure to microwave irradiation.

5. The package of claim 4 wherein the contacting areas on either side of the centrally located stripe are sealed together.

6. The package of claim 5 wherein the susceptor-laden contacting areas at either end of the stripe are sealed together.

7. The package of claim 5 wherein the susceptor-laden contacting area at either end of the centrally located stripe is shielded by means of at least one strip of microwave reflective foil laminated to paperboard and covering said contacting area on at least one leaf thereof.

8. The package of claim 7 wherein the microwave reflective foil laminated to paperboard covers only one leaf of said contacting area.

9. The package of claim 7 therein the foil laminated to paperboard is attached to the package and is provided with a perforated line, whereby the paperboard and the sealed end of the package can be ripped open to permit easy removal of the food contents after cooking.

10. The package of claim 5 wherein the susceptor-laden contacting area at either end of the centrally located stripe is shielded by means of a layer of conductive ink applied to at least one leaf thereof.

11. The package of claim 5 wherein the susceptor-laden contacting area at either end of the centrally located stripe is shielded by means of a layer of conductive ink applied to one leaf only thereof.

12. The package of claim 1 wherein the susceptor-laden contacting area is shielded by means of at least one strip of microwave reflective foil covering said coated contacting area on at least one leaf thereof.

13. The package of claim 12 wherein the foil is laminated onto paperboard.

14. The package of claim 13 wherein the foil laminated onto paperboard is further provided with a layer of heat sealable resin and the foil is sealed thereby to the pouch.

15. The package of claim 1 wherein the susceptor-laden contacting area is shielded on one leaf only by means of at least one strip of microwave reflective foil.

16. The package of claim 15 wherein the foil is laminated onto paperboard.

17. The package of claim 16 wherein the foil laminated onto paperboard is further provided with a layer of heat sealable resin and the foil is sealed thereby to the pouch.

18. The package of claim 1 wherein the susceptor laden contacting area is shielded by means of a layer of conductive ink applied to at least one leaf thereof.

19. The package of claim 1 wherein the susceptor laden contacting area is shielded by means of a layer of conductive ink applied to one leaf only thereof.

20. The package of claim 1 wherein the heat resistant film is selected from the group consisting of polyesters, polyarylates, cellophane, cellulose triacetate, ethylene chlorotrifluoroethhylene copolymers, fluorinated polyethylene, polytetrafluoroethylene, polycarbonates, polyimides, polyetherimides, polyamides, polysulfones, polyvinyl alcohol polymers, polyetherketones, and polymethylpentene.

21. The package of claim 20 wherein the heat resistant film is polyethylene terephthalate.

22. The package of claim 21 wherein the heat resistant film is a laminate comprising at least one layer of heat stabilized polyethylene terephthalate.

23. The package of claim 1 wherein the microwave susceptor material is at least one layer of vacuum deposited metal.

24. The package of claim 23 wherein the metal is aluminum.

25. The package of claim 23 wherein the metal is stainless steel.

26. A microwave cooking package suitable for cooking a food item which requires surface browning or crispening, comprising a front leaf and a back leaf formed from a single sheet of film, folded over on itself, said film having a microwave susceptor material in a centrally located stripe extending the length of said single sheet of film, perpendicular to the direction of the fold, said susceptor material being present in an amount to generate sufficient heat under microwave cooking conditions to brown or crispen the surface of said food item placed adjacent thereto, said front and back leaves contacting each other, face to face, in areas on either side of the centrally located stripe and in an area at either end of said stripe, said contacting areas on either side of the stripe being sealed together so as to form a pouch of a size and shape suitable for containing said food item, wherein said susceptor material extends over the portion of the contacting area at the end of said stripe, and wherein the susceptor-laden contacting area at the end of said stripe is shielded by means of a microwave reflective camp to minimize exposure to microwave irradiation, whereby said susceptor-laden contacting area does not overheat during microwave cooking.

27. A microwave cooking package suitable for cooking a food item which requires surface browning or crispening, comprising a front leaf and a back leaf formed from at least one heat resistant film, said film having a microwave susceptor material extending over at least a portion of its surface area in an amount to generate sufficient heat under microwave cooking conditions to brown or crispen the surface of said food item placed adjacent thereto, said front and back leaves being maintained inn contact with each other, face to face, in an area about the periphery of such front and back leaves so as to form a pouch of a size and shape suitable for containing said food item, wherein said susceptor material extends over at least a portion of the peripheral contacting area, and wherein said susceptor-laden portion of the peripheral contacting area is provided with a microwave reflective shield on at least one leaf thereof to minimize exposure to microwave irradiation, whereby said susceptor-laden contacting area does not overheat during microwave cooking, wherein said microwave susceptor material is aluminum flake embedded within a layer of thermoplastic material.

* * * * *

UNITED STATES PATENT AND TRADEMARK OFFICE

CERTIFICATE OF CORRECTION

PATENT NO. : 5,003,142

DATED : March 26, 1991

INVENTOR(S) : Robert Earl Fuller

It is certified that error appears in the above—identified patent and that said Letters Patent is hereby corrected as shown below:

In column 10 at line 1, the word "aid" should be -- said -- .

In column 12, line 12, the word "camp" should be -- clamp -- .

In column 12 at line 24, the word "inn" should be -- in -- .

Signed and Sealed this

Eighteenth Day of August, 1992

*Attest:*

DOUGLAS B. COMER

*Attesting Officer*

*Acting Commissioner of Patents and Trademarks*